United States Patent [19]

Spector

[11] Patent Number: 4,670,924

[45] Date of Patent: Jun. 9, 1987

[54] TRANSFORMABLE PILLOW

[76] Inventor: Donald Spector, 380 Mountain Rd., Union City, N.J. 07087

[21] Appl. No.: 876,415

[22] Filed: Jun. 20, 1986

[51] Int. Cl.[4] ..... A47C 20/02

[52] U.S. Cl. ..... 5/434; 5/441; 5/490

[58] Field of Search ..... 5/434, 436, 441, 490, 5/496, 482

[56] References Cited

U.S. PATENT DOCUMENTS

| | | | |
|---|---|---|---|
| 258,406 | 3/1881 | Elbaum et al. | 5/434 X |
| 944,910 | 12/1909 | Reilley | 5/490 |
| 1,269,276 | 6/1918 | Harris | 5/434 X |
| 1,861,668 | 6/1932 | Tenney | 5/441 |
| 2,961,668 | 11/1960 | Hayes | 5/434 |
| 3,346,892 | 10/1967 | DuPriest | 5/434 X |
| 3,378,948 | 4/1968 | Gervaise | 5/434 X |
| 4,133,064 | 1/1979 | Petrusek | 5/441 |
| 4,442,558 | 4/1984 | Alexander | 5/482 X |

FOREIGN PATENT DOCUMENTS

| | | | |
|---|---|---|---|
| 2452899 | 5/1976 | Fed. Rep. of Germany | 5/434 |
| 1601773 | 10/1970 | France | 5/434 |

OTHER PUBLICATIONS

"Industry" Magazine, May 1978, p. 46, Yeaple Stereo-pillow.

*Primary Examiner*—Alfred C. Perham
*Attorney, Agent, or Firm*—Michael Ebert

[57] ABSTRACT

A dual-function pillow which is transformable into a figurative form or character. In its normal mode the pillow serves as a comfortable head rest, while in its transformed mode it functions as a plaything. The pillow which has a soft and compressible body includes a rectangular bag or outer case whose face has applied thereto a two-dimensional figure or character. The bag or case is provided with one or more transversely-placed draw strings which when tightened act to constrict the pillow and to thereby impart contours thereto to define a main head portion and at least one secondary portion to create a three-dimensional form.

9 Claims, 5 Drawing Figures

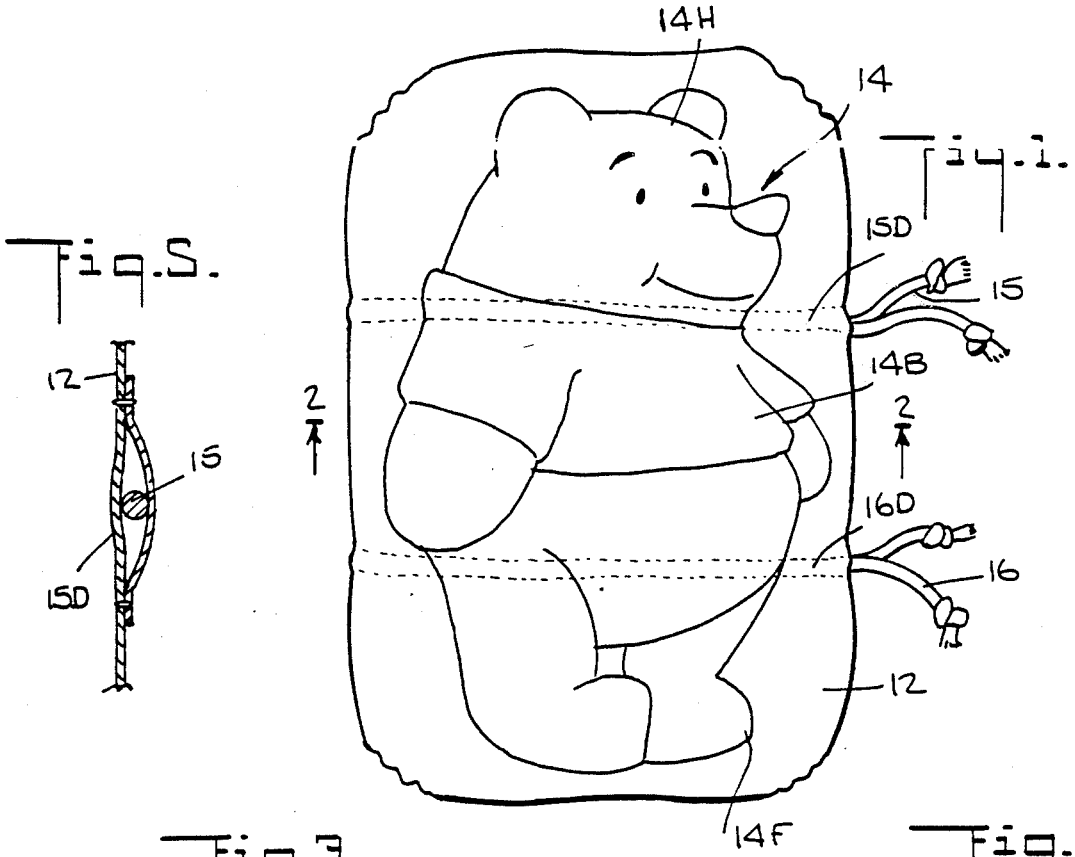
Fig. 1.
Fig. 5.
Fig. 3.
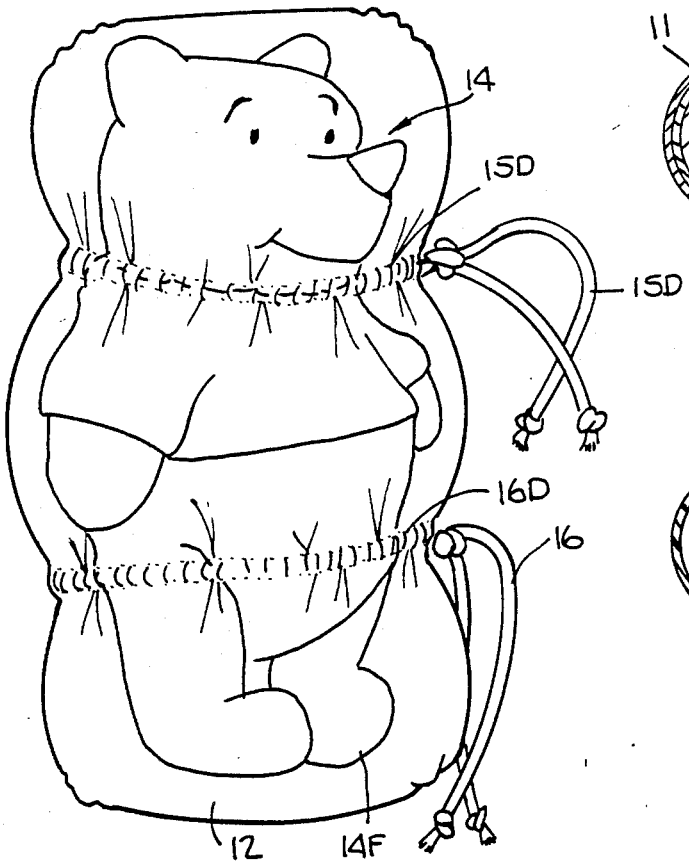
Fig. 2.
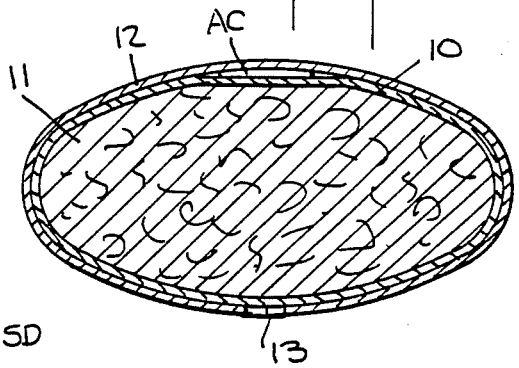
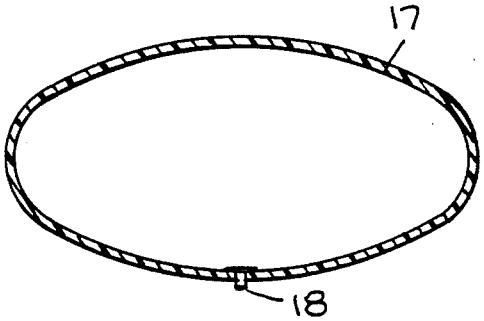
Fig. 4.

TRANSFORMABLE PILLOW

BACKGROUND OF INVENTION

1. Field of Invention

This invention relates generally to slumber pillows, and in particular to a dual-function transformable pillow that in its normal mode functions as a comfortable head rest, and in its transformed mode assumes a figurative form to serve as a plaything.

2. Status of Prior Art

A conventional pillow acts as a support for the head of a reclining individual and generally takes the form of a rectangular fabric bag filled with feathers, down, a foam-plastic pad or plastic fibers which produce a soft, compressible body. Pillows are often provided with a removable pillow case made of linen or cotton which protects the pillow from dirt. Hence when the pillow case is soiled, it can be removed and cleaned, the pillow itself remaining untouched.

In the case of children, a pillow also serves as a comforter; for when the head of a child rests on a pillow and is in intimate contact therewith, the soft pillow becomes warm and acts as a warm nest which imparts a sense of security to the child. Thus, in the mind of a child, a pillow ceases to be an inanimate object. Children also use pillows as playthings, and so-called pillow fights in which children hurl pillows at each other are commonplace.

To further personalize a pillow and to give it individuality, it is known to so shape or contour the pillow as to create a figurative form. Thus, the U.S. Pat. Nos. D. 258,406 to Elbaum et al. and Hayes 2,961,668 show pillows in figurative forms. In the Hayes patent, the pillow includes simulated head and body portions as well as elongated arms that can be wrapped about the neck of the sleeping child so as to stimulate cuddling of the child by an older person.

The practical drawback of a contoured pillow which has a figurative form is that this form is not well suited to carry out the primary function of the pillow, which is that of a head rest. Best suited for this purpose is the conventional rectangular pillow.

Normally, the head of the reclining child rests on the center of the rectangular pillow, so that if in the course of sleep, should the head be shifted to either side of center, it will continue to be supported by a side portion of the pillow. But should the pillow itself be head shaped as in the Hayes patent, then the head of the child will roll off the pillow when the head shifts to one side in the course of sleep. Thus by contouring of the pillow, one sacrifices to some degree its normal head rest characteristics.

SUMMARY OF INVENTION

In view of the foregoing, the main object of this invention is to provide a transformable dual-function pillow which in its normal slumber mode has the shape of a conventional pillow, and in its transformed mode has a figurative or three-dimensional character form.

A significant advantage of the invention is that the pillow in its normal slumber mode is fully as comfortable as a conventional pillow, whereas in its transformed mode, it is an attractive and appealing plaything.

Thus when pillows in accordance with the invention in their transformed modes assume the form of characters now popular with children, such as animals or extraterrestrial characters, then children can identify with these characters and engage in pillow fights therewith rather, than with nondescript conventional pillows, thereby enhancing the enjoyment of this play activity. And the pillows in their transformed mode may be used as stuffed dolls.

More particularly, an object of this invention is to provide a transformable pillow which makes use of draw strings that when tightened act to transform the pillow form into a contoured character form.

Briefly stated, these objects are attained in a dual-function pillow which is transformable into a figurative form or character. In its normal mode the pillow serves as a comfortable head rest, while in its transformed mode, it functions as a plaything. The pillow which has a soft and compressible body includes a rectangular bag or outer case whose face has applied thereto a two-dimensional figure or character. The bag or case is provided with one or more transversely-placed draw strings which when tightened act to constrict the pillow and to thereby impart contours thereto to define a main head portion and at least one secondary portion to create a three-dimensional form.

OUTLINE OF DRAWINGS

For a better understanding of the invention as well as other objects and further features thereof, reference is made to the following detailed description to be read in conjunction with the accompanying drawing, wherein:

FIG. 1 illustrates a transformable pillow in accordance with the invention as seen from the front face thereof in its normal slumber mode;

FIG. 2 is a transverse section taken through the pillow in the plane by line 2—2 in FIG. 1;

FIG. 3 shows the same pillow in its transformed mode;

FIG. 4 shows in transverse section a pneumatic pillow in accordance with the invention; and FIG. 5 is a section taken through the pillow to show one of the draw string ducts.

DESCRIPTION OF INVENTION

Referring now to FIGS. 1 and 2, there is shown a dual-function pillow in accordance with the invention, the pillow being formed by a bag 10 of generally rectangular form made of a suitable fabric, the bag being stuffed with a soft, compressible filler 11 which may be down or any other known material for this purpose.

The pillow is provided with a removable outer case 12 having the same form and preferably made of a plush-like material so as to stimulate the skin or fur of an animal such as a teddy bear. Case 12 is provided with a rear zipper 13 that extends most of its length, or other means such as a Velcro fastener placed along a rear slit, making it possible to insert the pillow in the case or to remove it therefrom so that the case can be cleaned.

Imprinted or otherwise applied to the top face of pillow case 12, as shown in FIG. 1, is a two-dimensional figure 14 which in the example shown is that of a well-known bear-like character having a head 14H, a body 14B and feet 14F. Case 12 is provided with two draw strings 15 and 16. String 15 passes through a transversely-positioned duct 15D formed in the case at about the junction between head 14H and body 14B, the duct extending through the front and rear of the case. String 10 passes through a transversely-positioned duct 16D formed in the case at about the junction between body 14B and feet 14F.

Hence when draw string 15 is tightened and then knotted to hold it tight, this acts, as shown in FIG. 3, to constrict the junction between head 14H and body 14B; while when draw string 16 is similarly tightened and knotted, this acts to constrict the junction between body 14B and feet 14F. The resultant contouring of the pillow is such as to impart a three-dimensional form to the two-dimensional figure imprinted on the face of the pillow, so that in the transformed mode the pillow is no longer in a generally rectangular shape but is in a contoured shape suggestive of the animal or other character pictured thereon.

The invention is not limited to two draw strings, for the number of draw strings used and their positioning in the pillow case depends on the character to be formed in the transformed mode. Also, it is not necessary that the character be imprinted on the pillow case, for the case may be manufactured with a blank face which is of a material that lends itself to drawing thereon by crayon or water paint. Thus, the child who acquires the pillow can draw on its face a character that suits his fancy. Or what can be imprinted thereon is a cartoon or outline of a character which the child can then color as he wishes, so that the transformable pillow is convertible into a character created by the child and not the manufacturer.

Rather than use a removable pillow case, the pillow bag 10 can be imprinted on its face and provided with draw strings so that the pillow can be converted into a character. In this instance, the pillow bag is preferably made of an impermeable material such as fabric having a plastic facing skin laminated thereto which can be cleaned by a sponge.

And instead of using a conventional pillow having a filler therein, the pillow may be of the pneumatic type shown in FIG. 4, the pillow being formed by an inflatable bladder 17 having a valve 18.

While there has been shown and described a preferred embodiment of a transformable pillow in accordance with the invention, it will be appreciated that many changes and modifications may be made therein without, however, departing from the essential spirit thereof.

Thus, to render the pillow more useful to a child, one may insert therein a settable electronic alarm clock, such as a miniature alarm clock with a digital readout and an audible alarm marketed by the Howard Miller Clock Company. This is in a flat credit card format and is called the "Alarm Card." This may be housed in a small soft fabric pouch and placed within the pillow so that when the alarm goes off, it can be heard only by the child sleeping on the pillow. Thus, as shown in FIG. 3, the flat alarm clock AC is placed between the pillow bag 10 and the pillow case 12. Also, the pillow may be provided with a battery-operated motorized mechanism adapted to tighten the draw strings at wake-up time to convert the pillow into a character and to later loosen the strings at a go-to-bed time and thereby again transform the character into a sleeping pillow. For this purpose, the draw string operating mechanism is operatively coupled to a settable electronic timer which can be set to any desired "wake-up" and "go-to-bed" time.

I claim:

1. A dual-function pillow having an outer cover whose face has a character drawn in two dimensions printed thereon, said cover having draw strings transversely positioned thereon which extend through respective ducts in the cover at positions displaced from the ends of the cover and whose placement relative to that of the character is such that when the draw strings are tightented to constrict the pillow, the resultant contouring of the pillow transforms the two-dimensional character into a three-dimensional figure whose form is generally that of the character; the pillow when the draw strings are loose being usable as a conventional head rest.

2. A dual-function pillow as set forth in claim 1, wherein said cover is a bag having a rectangular form.

3. A dual-function pillow as set forth in claim 1, wherein said cover is a removable pillow case.

4. A dual-function pillow as set forth in claim 3, wherein said case is formed of a plush-like fabric.

5. A dual-function pillow as set forth in claim 4, wherein said case has a zippered rear slit.

6. A dual-function pillow as set forth in claim 1, wherein said pillow has a soft, compressible filler therein.

7. A dual function pillow as set forth in claim 1, wherein said pillow is formed by an inflatable bladder.

8. A dual-function pillow as set forth in claim 1, wherein said character has a head, a body and feet, and wherein one draw string is positioned at about the junction of the head and body and another draw string is positioned at about the junction of the body and the feet.

9. A dual-function pillow as set forth in claim 1, wherein said face has a surface on which the character may be drawn by the user.

* * * * *